US005174537A

United States Patent [19]

Mazzorato

[11] Patent Number: 5,174,537

[45] Date of Patent: Dec. 29, 1992

[54] SUPPORT FOR PRICE MARKER SIGNS AND THE LIKE, PARTICULARLY FOR DISPLAYS FOR ITEMS OF CLOTHING

[75] Inventor: Giuseppe Mazzorato, Castelminio, Italy

[73] Assignee: Leamm S.r.l., Castelminio di Resana, Italy

[21] Appl. No.: 647,881

[22] Filed: Jan. 30, 1991

[51] Int. Cl.[5] ..... B42F 13/00

[52] U.S. Cl. ..... 248/340; 248/227

[58] Field of Search ..... 248/340, 341, 303, 304, 248/294, 297.1, 123.1, 690, 692, 121, 227; 40/613, 602, 617, 606, 607

[56] References Cited

U.S. PATENT DOCUMENTS

| | | | |
|---|---|---|---|
| 1,858,152 | 5/1932 | Hallowell et al. | 40/606 |
| 2,288,071 | 6/1942 | Cohen | 40/11 |
| 2,324,093 | 6/1943 | Lhamon | 223/88 |
| 3,030,718 | 4/1962 | Kirkman | 40/613 X |
| 3,217,893 | 11/1965 | Fleischman | 211/94.5 |
| 3,792,804 | 2/1974 | Ponzo | 248/340 X |
| 3,880,280 | 4/1975 | Fyvolent | 206/44.12 |
| 4,159,587 | 7/1979 | Slavsky | 40/606 X |
| 4,503,631 | 3/1985 | Kelly | 40/613 X |
| 4,726,132 | 2/1988 | Ernest | 40/606 X |
| 4,776,116 | 10/1988 | Shuman | 40/606 X |
| 4,860,984 | 8/1989 | Alperson | 248/340 X |
| 4,884,351 | 12/1989 | Abramson | 40/606 |

*Primary Examiner*—Ramon O. Ramirez
*Attorney, Agent, or Firm*—Guido Modiano; Albert Josif

[57] ABSTRACT

The support for price marker signs comprises a central body provided with an engagement element which is suitable for being hung from the horizontal rail of the displays generally used in shops. A counterweight is fixed below the central body and a sign, having a support for a writable surface, is connected above the central body. The support autonomously assumes and stably maintains a correct vertical position even after repeated movements of the display and continuous manipulations of the items on display.

15 Claims, 2 Drawing Sheets

SUPPORT FOR PRICE MARKER SIGNS AND THE LIKE, PARTICULARLY FOR DISPLAYS FOR ITEMS OF CLOTHING

BACKGROUND OF THE INVENTION

The present invention relates to a support for price marker signs and the like, particularly suitable for being used in combination with displays for items of clothing.

Due to the wide variety of products, in the field of clothing in general there is an evident need to use marker signs which, arranged among the items on display, indicate their essential characteristics, such as size, price, any sales promotions and so forth, to the purchaser.

Signs which are fixed at the top of rod-like supports rigidly fixed to the structure of the display are therefore known and commonly used for this purpose.

Said known supports can thus have grip clamps or accommodations for complementarily shaped protrusions provided in the display itself, or can be simply fixed by means of adhesive tape or the like.

However, although they are commonly used, said known types of sign are not free from disadvantages, including most of all the fact that they do not ensure a stable and safe vertical position but are instead subject to displacements and falls, very often assuming unaesthetic and scarcely reliable inclined positions, also due to the continuous actions on the display on the part of customers and of display sales personnel.

SUMMARY OF THE INVENTION

The aim of the present invention is to provide a price marker sign which, by virtue of its peculiar structural characteristics, autonomously assumes and then stably maintains a correct vertical position without being affected by the movements and motions imparted to the display and to the items.

Within the scope of the above described aim, a particular object of the invention is to provide a price marker sign which is associable with various displays in an extremely simple and rapid manner, without requiring clamps or insertion couplings and which furthermore, for the same reason, can be moved between different displays or along the same display.

Another important object is to provide a sign with the above peculiarities which can furthermore be associated with a base of an extremely simple and economical type, for the placement of planar surfaces.

Not least object is to provide a support for display signs which is structurally very simple and can be obtained without particular constructive difficulties starting from easily commercially available materials and elements so as to have a very modest cost which facilitates its widespread diffusion.

This aim, the objects mentioned and others which will become apparent hereinafter are achieved, according to the invention, by a support for price marker signs and the like particularly for displays of items of clothing, characterized in that it comprises a central body provided with an engagement means adapted for being hung from the horizontal rod-like elements of a display, a counterweight being connected below said central body, a sign or a support for a writable surface being connected above said central body.

BRIEF DESCRIPTION OF THE DRAWINGS

Further characteristics and advantages will become apparent from the description of three preferential embodiments of the invention, illustrated only by way of non-limitative example in the accompanying drawings, wherein.

DESCRIPTION OF THE PREFERRED EMBODIMENTS

Figure 1:
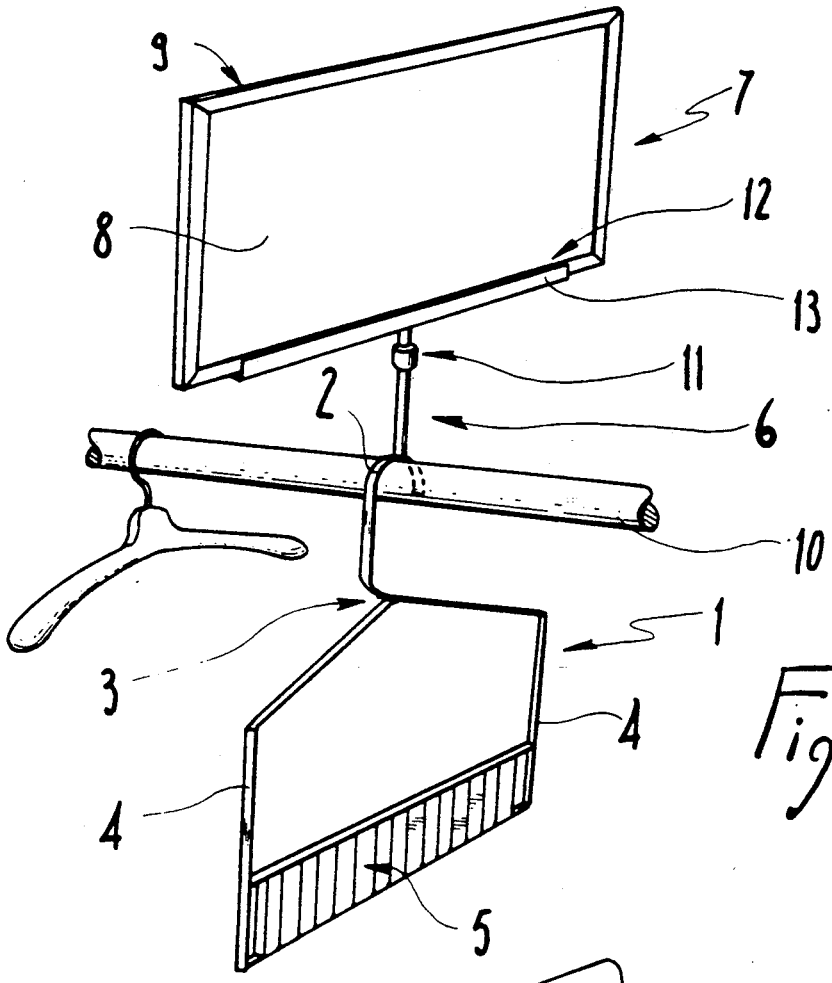
FIG. 1 is a front view of the first embodiment of the invention.

With reference to FIG. 1, a first embodiment of support, generally indicated by the reference numeral 1, comprises a hook 2, for example made of metal, the stem 3 whereof is divided into two arms 4 arranged in the same plane. Advantageously, the arms 4 diverge away from the stem 3 and then extend parallel to each other. A counterweight 5 is connected to the ends of the arms 4; said counterweight is conveniently constituted by a flat plate, for example made of metallic material.

According to the invention, a rod 6 extends upwardly from the top of the hook 2, on the opposite side with respect to the counterweight 5, and a marker sign 7 is connected to the upper end of said rod; said marker sign is appropriately constituted by a writable surface 8 surrounded by a frame 9 which is also, for example, made of metal.

For the sake of completeness in description, it should be noted that in order to allow subsequent reuse the writable surface 8 can be of the glossy type which, by using particular felt pens, allows to erase the writing simply by wiping.

The use of the support 1 is evident and consists in hanging it by means of the hook 2 to one of the horizontal tubular elements commonly present in displays of items of clothing, such as for example the bar 10, between the coat-hangers which support the items on display.

The weight itself of the counterweight 5 keeps the sign constantly vertical, returning it to its correct position even after impacts or casual displacements.

It is furthermore evident that the predominantly planar extension facilitates the insertion of the sign between the various items, practically eliminating its space occupation and providing an extremely valid means for separating the displayed products, for example dividing them by size, model and so forth.

At this point it should furthermore be observed that at the top of the rod 6 there is an articulation 11 which allows the rotation of the sign 7 about the axis of said rod so as to be able to orientate the writing toward the direction which is deemed best. Said articulation 11 is essentially constituted by a telescopic coupling with axial locking between the enlarged top of the rod 6 and a tubular stem which extends from the frame 9.

Figure 2:
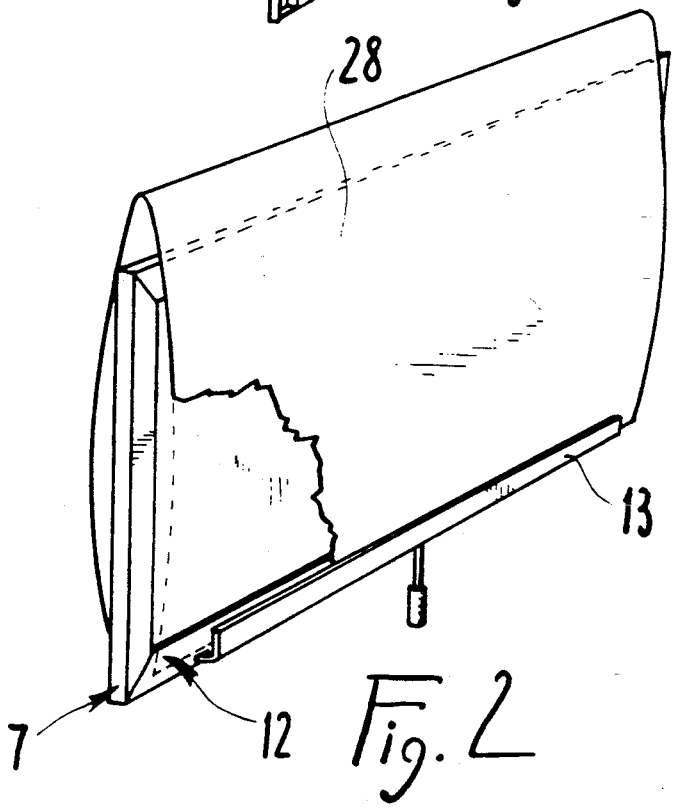
FIG. 2 is a perspective view of a detail of the support related to holders for additional signs.

It is furthermore important to notice, as more clearly shown in FIG. 2, that a pair of profiled elements 13 is present along the lower section 12 of the frame 9; said profiled elements have an essentially L-shaped transverse cross section, and by extending on the two sides of the sign 7 they allow the temporary placement, astride said surface, of auxiliary or additional signs 28 to indicate particular sales promotions, limited-time offers, new arrivals and so forth.

According to the invention, the particular laminar configuration of the counterweight 5, besides reducing bulk, is particularly advantageous for associating with the support 1 a resting base for use on flat surfaces, such as for example tables, ledges, brackets or shelves.

Figure 3:
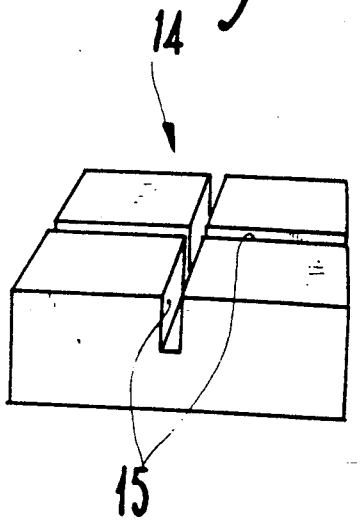
FIG. 3 is a perspective view of a base for resting on planar surfaces.

An example of execution of said base is illustrated in FIG. 3 with the reference numeral 14.

Said base is essentially constituted by a solid body with a parallelepipedal shape, on the upper face whereof one or more slots 15 extend; said slots have a width which is substantially equal to that of the counterweight 5.

Said slots 15 are deep enough so that the support 1 remains stably vertical when the counterweight is inserted therein.

The invention thus conceived is obviously susceptible to numerous structural and aesthetic modifications and variations, all of which are in any case within the scope of the same inventive concept.

Figure 4:
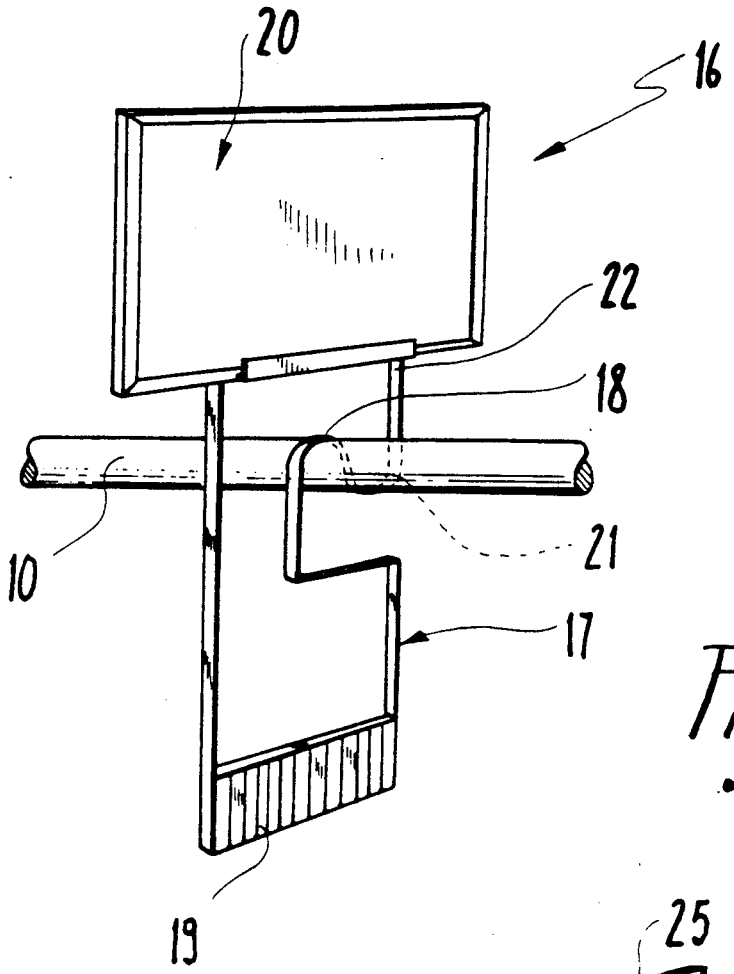
FIGS. 4 and 5 are front views respectively of a second embodiment and of a third embodiment of the support.

Thus, for example, a second embodiment indicated in FIG. 4 by the reference numeral 16 is characterized in that the central body of the support is constituted by a single bent and shaped metallic profiled element 17.

Said profiled element 17 in fact defines a hook 18, extends perimetrically around the counterweight 19 and then extends upwardly again until it connects to the sign 20 at its own upper end; on the other side, the same profiled element, after defining the descending portion 21 of the hook 18, is bent upward and extends until it connects to the sign at the connection point 22.

Although said second embodiment maintains all the peculiar characteristics of the invention, it can obviously offer particular styling and aesthetic results and is also extremely simple from the point of view of manufacture.

Figure 5:
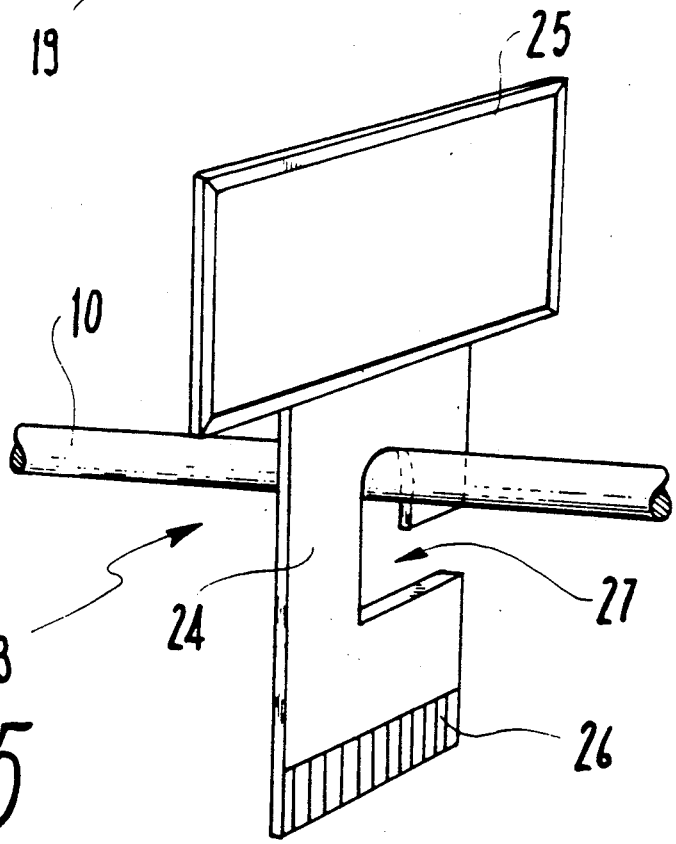

A third embodiment 23, illustrated in FIG. 5, is characterized in that the central body of the support is constituted by a laminar element 24, for example made of transparent or translucent plastic material or simply of cardboard or the like, to which a sign 25 and a counterweight 26, similar to the ones described above, are fixed on opposite sides.

Conveniently, the element for engaging the display is simply defined by a cutout portion 27 which penetrates laterally and then rises toward the sign 25.

In practice it has been thus observed that a support according to the invention is particularly functional and has many possibilities for use. The support is suitable for various uses even in different fields, used both hung and rested, always maintaining unchanged characteristics of simplicity and practicality.

As already observed, it is furthermore suitable for being manufactured in a plurality of different shapes and configurations, so as to be also aesthetically pleasant and innovative.

In practice, the materials employed, so long as compatible with the contingent use, as well as the dimensions, may be any according to the requirements.

I claim:

1. Support for price marker signs, particularly for displays of items of clothing, comprising a central body, said central body being provided with an engagement element, said engagement element being hangable from a horizontal rod-like display element, a counterweight being connected below said central body, a sign or a support for a writable surface being connected above said central body, wherein said central body is constituted by a single bent and shaped metallic profiled element, said profiled element defining a hook, said hook having a stem, said stem extending so as to perimetrically embrace said counterweight, said stem extending upwardly from said counterweight and being connected to said sign, said hook having a descending portion, said profiled element defining said descending portion of said hook and having another side, said profiled element being bent upward at said other side and extending upward up to said sign.

2. Support according to claim 1, wherein said sign comprises a writable surface and a rigid frame, said writable surface being surrounded by said rigid frame, wherein said frame has a lower section, and wherein said sign has opposite sides, said support further comprising a pair of profiled elements, said profiled elements having an essentially L-shaped transverse cross section and extending along said lower section of said frame on said opposite sides of said sign, whereby to allow placement of auxiliary signs astride said frame.

3. Support according claim 1, wherein said sign is connected to said central body by means of an articulation, said articulation allowing rotation of said sign about a vertical axis.

4. Support according to claim 1, wherein said counterweight is essentially constituted by a planar plate, said planar plate being made of material having a high relative density.

5. Support according to claim 1, wherein said counterweight is associable with a resting base for use on flat surfaces.

6. Support according to claim 5, wherein said resting base comprises a solid body having an upper surface and wherein said counterweight defines a width, said solid body having a parallelepipedal shape, one or more slots being defined on said upper face, said slots having a width which is substantially equal to said width of said counterweight, said counterweight being insertable into said slots, said slots being deep enough so that, when said counterweight is inserted therein, said support remains stably vertical.

7. Support for price marker signs, particularly for displays of items of clothing, comprising a central body, said central body being provided with an engagement element, said engagement element being hangable from a horizontal rod-like display element, a counterweight being connected below said central body, a sign or a support for a writable surface being connected above said central body, wherein said sign comprises a frame, said frame having a lower section, and wherein said sign has opposite sides, said support further comprising a pair of profiled elements, said profiled elements extending along said lower section of said frame on said opposite sides of said sign, whereby to allow placement of auxiliary signs astride said frame.

8. Support according to claim 7, wherein said profiled elements have an essentially L-shaped transverse cross section.

9. Support according to claim 7, wherein said central body is constituted by a shaped metallic profiled element, said shaped profiled element defining a hook, said hook having a stem, said stem extending so as to perimetrically embrace said counterweight, said stem extending upwardly from said counterweight and being connected to said sign, said hook having a descending portion, said profiled element defining said descending portion of said hook and having another side, said profiled element being bent upward at said other side and extending upward up to said sign.

10. Support according claim 7, wherein said sign is connected to said central body by means of an articulation, said articulation allowing rotation of said sign about an axis, said axis being perpendicular with respect to said lower section.

11. Support according to claim 7, wherein said counterweight comprises a planar plate, said planar plate being made of material having a high relative density.

12. Support according to claim 11, wherein said counterweight is associable with a resting base for use on flat surfaces, and said resting base comprises a solid body having an upper frame surface and wherein said counterweight defines a width, said solid body having a parallelepipedal shape, at least one slot being defined on said upper face, said slot having a width which is substantially equal to said width of said counterweight, said counterweight being partially accommodatable in said slot for maintaining said support in a vertical position.

13. Support for price marker signs, particularly for displays of items of clothing, comprising a central body, said central body being provided with an engagement element, said engagement element being hangable from a horizontal rod-like display element, a counterweight being connected below said central body, said counterweight comprising a planar plate, said planar plate being made of material having a high relative density, a sign or a support for a writable surface being connected above said central body, wherein said sign comprises a frame, said frame having a lower section, and wherein said sign has opposite sides, said support further comprising a pair of profiled elements, said profiled elements each having an L-shaped transverse cross section extending along said lower section of said frame on said opposite sides of said sign, whereby to allow placement of auxiliary signs astride said frame.

14. Support according to claim 13, wherein said central body is constituted by a shaped profiled element, said shaped profiled element defining a hook, said hook having a stem, said stem perimetrically embracing said counterweight, said stem extending upwardly from said counterweight and being connected to said sign, said hook having a descending portion, said shaped profiled element defining said descending portion of said hook and having another side, said shaped profiled element being bent upward at said other side and extending upward up to said sign.

15. Support according to claim 13, wherein said counterweight is associable with a resting base for use on flat surfaces, and, wherein said resting base comprises a solid body having an upper frame surface and wherein said counterweight defines a width, said solid body having a parallelepipedal shape, at least one slot being defined on said upper face, said slot having a width which is substantially equal to said width of said counterweight, said counterweight being partially accommodatable in said slot for maintaining said support in a vertical position.

* * * * *